US006029735A

United States Patent [19]

Nicholson

[11] Patent Number: 6,029,735

[45] Date of Patent: Feb. 29, 2000

[54] CLUTCH MECHANISM FOR MANUAL ROLLER DOOR OPERATION

[76] Inventor: Scott Nicholson, 15 Dell Road, West Gosford NSW 2250, Australia

[21] Appl. No.: 09/213,960

[22] Filed: Dec. 17, 1998

[30] Foreign Application Priority Data

Dec. 18, 1997 [AU] Australia ..... PP0996

[51] Int. Cl.[7] ..... E06B 9/08

[52] U.S. Cl. ..... 160/321; 160/133; 74/625

[58] Field of Search ..... 160/309, 133, 160/188, 189, 310, 321, 300, 301, 302; 74/625

[56] References Cited

U.S. PATENT DOCUMENTS

| | | | |
|---|---|---|---|
| 2,819,628 | 1/1958 | Wardlaw | 160/133 X |
| 2,957,521 | 10/1960 | Greegor | 160/133 |
| 3,512,302 | 5/1970 | Sivin et al. | 160/133 X |
| 3,637,004 | 1/1972 | Wardlaw et al. | 160/133 |
| 4,392,392 | 7/1983 | Perisic et al. | 160/133 X |
| 4,721,146 | 1/1988 | Wardlaw | 160/310 |
| 4,976,168 | 12/1990 | Lotznicker et al. | 160/310 X |
| 5,083,600 | 1/1992 | Weishar et al. | 160/133 X |
| 5,839,555 | 11/1998 | Hsieh | 160/310 X |

*Primary Examiner*—David M. Purol

*Attorney, Agent, or Firm*—Cohen, Pontani, Lieberman, Pavane

[57] ABSTRACT

A clutch mechanism adapted to facilitate disengageable manual operation of a roller door or shutter comprising a chain pulley wheel journalled for rotation about the axis of a first shaft permanently engaged with or common with the main shaft about which the door or shutter is stored but not constrained to rotate with the first shaft at times when such shaft is driven other than manually; a clutch disc journalled alongside the chain pulley wheel on the same axis and similarly free to rotate independently of the first shaft; a linking pin on the chain pulley wheel between the chain pulley wheel and the clutch disc to link the chain pulley wheel to the clutch disc such that rotation of one causes rotation of the other about their common axis; biasing springs on the clutch disc constraining the free end of the linking pin to bias the linking pin into an equilibrium linked position; the biasing springs being sufficiently weak that a light tug on the chain about the chain pulley wheel will allow limited relative rotational movement of the chain pulley wheel relative to the clutch disc out of the equilibrium linked position; a driven disc interposed between the chain pulley wheel and the clutch disc and keyed to the first shaft so as to preclude independent rotation of the driven disc with respect to the shaft; a drive pawl mounted to the clutch disc about a pivot on the disc at a point non-concentric with the axis about which the clutch disc rotates.

5 Claims, 5 Drawing Sheets

CLUTCH MECHANISM FOR MANUAL ROLLER DOOR OPERATION

BACKGROUND OF THE INVENTION

1. Field of the Invention

The present invention relates to a clutch mechanism to facilitate manual operation of roller doors or shutters which are normally motor driven.

2. Description of the Related Art

Roller doors and shutters are in widespread use in connection with warehouses, factories, garages and many other applications and such roller doors and shutters are typically motor driven by electric motors.

In the event of power failures, fire or other unforseen eventualities the motor driven feature of roller and/or shutter doors may not be operable and it is consequently desirable and indeed mandatory in many applications that manual operation of the doors and/or shutters may be readily achieved independently of the motorised feature. Manual operation of such doors is often achieved by way of an endless chain extending about an overhead chain pulley wheel in turn journalled on an overhead shaft engagable with the shaft about which the roller door or shutter is wound; the chain extending down to an area adjacent ground level whereat it may be pulled by an operator in order to rotate the wheel and shaft and hence the door.

If the chain is to permanently reside on the chain pulley wheel then the chain pulley wheel cannot rotate during ordinary powered operation of the door or shutter having regard to the fact that the high rpm occasioned by motorised operation would cause derailment. It is therefore desirable that a clutch be present in the door mechanism in order that the chain pulley wheel only be engaged with the shaft when the door is to be manually operated.

Various such clutch mechanisms have been proposed to date although most of these are, inconvenient to operate or expensive to manufacture.

SUMMARY OF THE INVENTION

It is accordingly an object of the present invention to provide a clutch to facilitate engagement of a chain pulley wheel with the main shaft about which a roller door is rolled when it is intended to manually operate the door. Alternatively it is an object of the present invention to provide the market with a further choice of product.

According to the present invention there is provided a clutch mechanism adapted to facilitate disengageable manual operation of a roller door or shutter comprising a chain pulley wheel journalled for rotation about the axis of a first shaft permanently engaged with or common with the main shaft about which the door or shutter is stored but not constrained to rotate with the first shaft at times when such shaft is driven other than manually; a clutch disc journalled alongside the chain pulley wheel on the same axis similarly free to rotate independently of the first shaft; linking means to link the chain pulley wheel to the clutch disc such that rotation of one causes rotation of the other about their common axis; biasing means to bias the linking means into an equilibrium linked position such that the abovementioned link between clutch disc and chain pulley wheel is operative; the biasing means being sufficiently weak that a light tug on the chain about the chain pulley wheel will cause the linking means to disengage to the extent that the chain pulley wheel may rotate to at least a small extent without co-extensive rotational movement of the clutch disc; a driven disc interposed between the chain pulley wheel and the clutch disc and keyed to the first shaft so as to preclude independent rotation of the driven disc with respect to the shaft; a drive pawl mounted to the clutch disc about a pivot on the disc at a point non-concentric with the axis about which the clutch disc rotates; the pawl being linked at one point removed from the pivot with a part of the chain pulley wheel and being adapted for movement, under the influence of such link, about its pivot from a disengaged position whereat it does not contact or lock against the driven disc to an engaged position whereat it directly or indirectly locks into the driven disc thereby causing the driven disc, clutch disc and pulley wheel to rotate as one; the link between the chain pulley wheel and pawl being such that with the clutch wheel and pulley wheel in their equilibrium position under the influence of the biasing means the pawl adopts its disengaged position with respect to the driven disc whereas the drive pawl moves about its pivot to its engaged position with respect to the driven disc whenever a pull exerted by the chain on the pulley wheel overcomes the biasing means which maintains the equilibrium position between the clutch disc and the chain pulley wheel.

BRIEF DESCRIPTION OF THE DRAWINGS

One embodiment of the present invention will now be described with reference to the accompanying drawings in which.

DETAILED DESCRIPTION OF THE PREFERRED EMBODIMENTS

Figure 1:
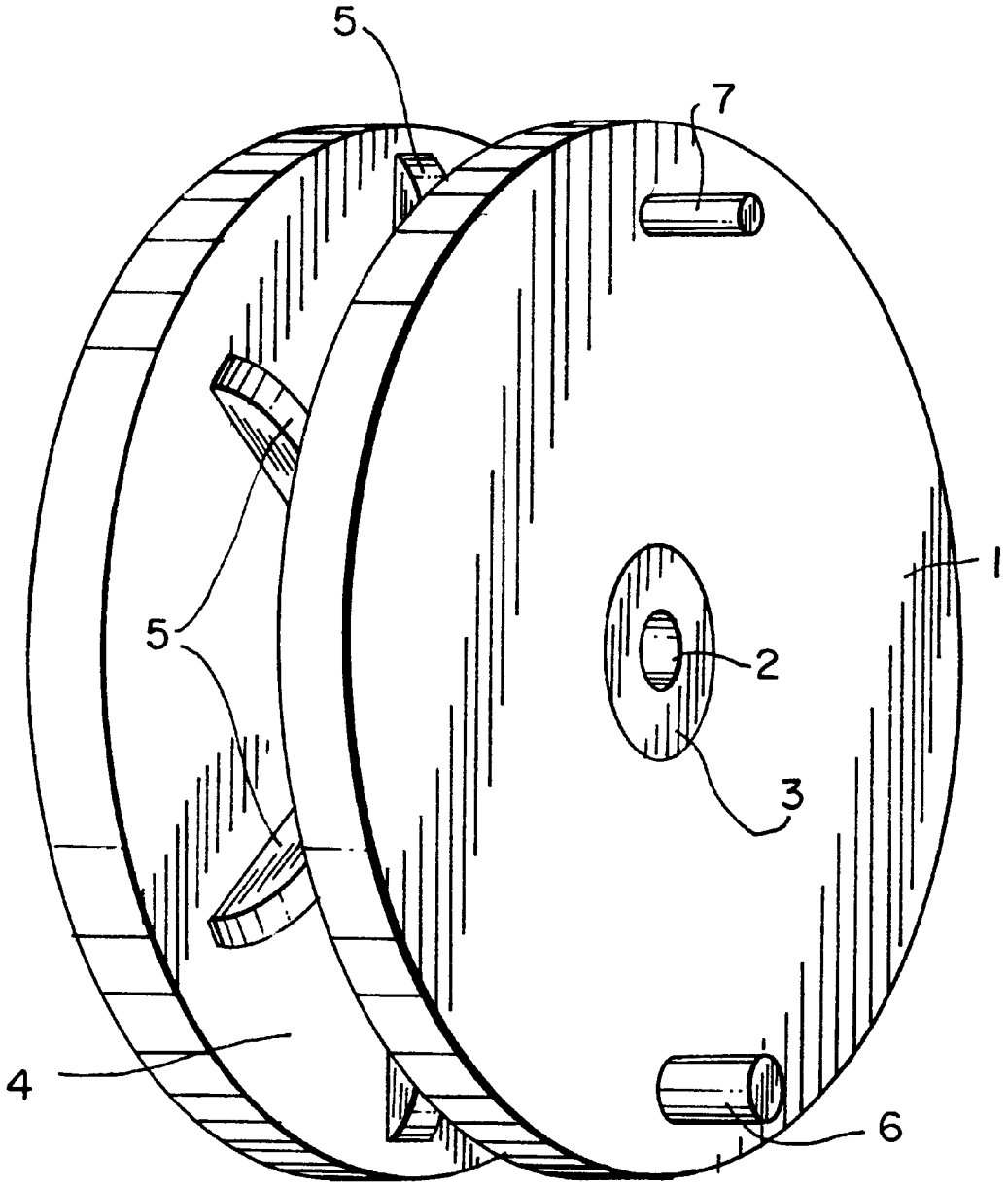
FIG. 1 is a perspective view of a chain pulley wheel in accordance with the present invention.

FIG. 1 depicts a chain pulley wheel 1 being adapted for journalling about a shaft (not shown) along its central axis 2 by means of bearings 3. The wheel is provided with a central groove 4 adapted to receive a chain (not shown) and having transverse bulkheads 5 in the groove 4 in order to prevent slippage of the chain (not shown). It will also be observed that one side of the pulley carries a projecting spring pin 6 adjacent a peripheral portion and at a point one hundred and eighty degrees removed from the spring pin a drive pin 7 of similar configuration.

Figure 2:
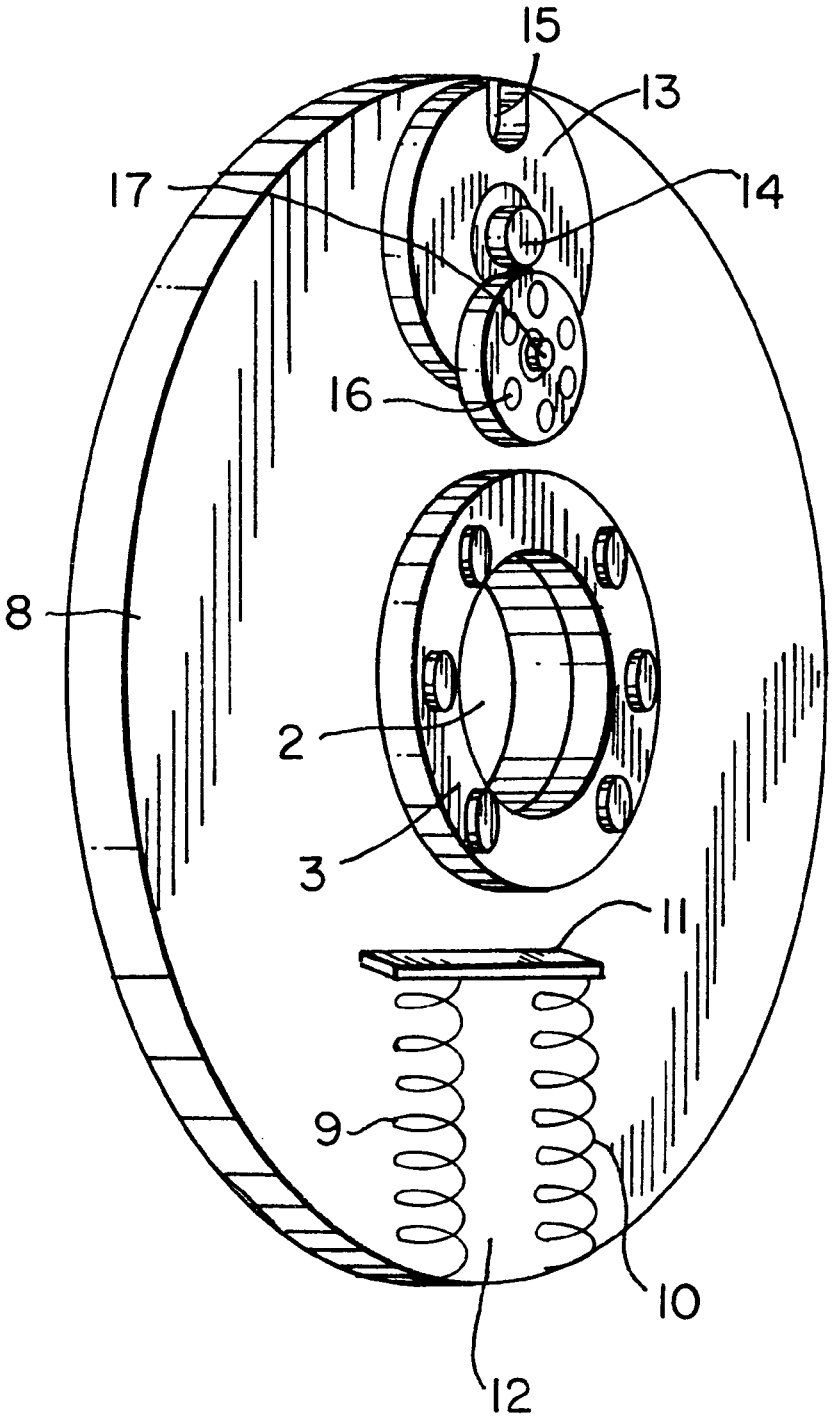
FIG. 2 is a side elevation of a clutch disc and associated pawl mechanism in accordance with the present invention.

With reference now to FIG. 2 there is disclosed a clutch disc 8 adapted to be journalled on the same shaft (not shown) as the above described chain pulley wheel. The clutch disc is similarly provided with a central axis 2 and bearings 3 in order that it may be journalled about such shaft (not shown). The clutch disc is intended to be mounted alongside the chain pulley wheel with the face of the clutch disc depicted in FIG. 2 adjacent the face of the chain pulley wheel depicted in FIG. 1 with the spring pin 6 of the chain pulley wheel adapted to lie between springs 9 and 10 mounted on upstanding flange 11 on the face of clutch disc 8. It will be observed that the space between springs 9 and 10 defines a passage 12 in which spring pin 6 may lie.

One hundred and eighty degrees removed from the springs 9 and 10 and passage 12 is drive pawl 13 comprising a substantially circular plate centrally mounted to the clutch disc about pivot pin 14. Drive pawl 13 is provided with slot 15 adapted to accept drive pin 7 of chain pulley wheel 1 and is further provided with drive wheel 16 mounted thereto about secondary pivot pin 17.

Figure 3:
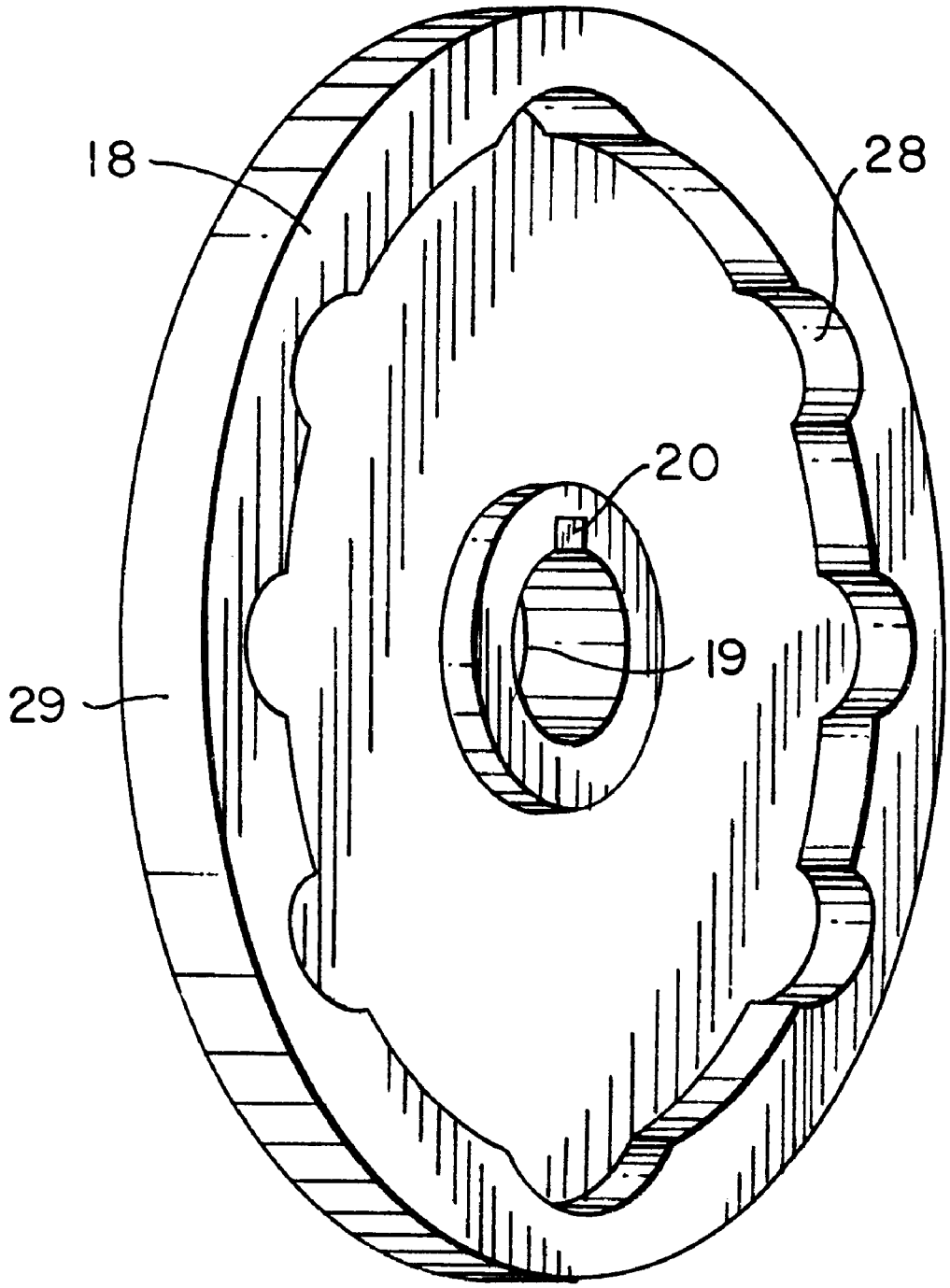
FIG. 3 is a perspective view of a driven disc in accordance with the present invention.

FIG. 3 depicts a driven disc 18 intended to be mounted about its central aperture 19 on the same shaft as chain pulley wheel 1 and clutch disc 8 although in the case of driven disc 18 the disc is positively mounted to the shaft and locked thereto by way of a key (not shown) in keyway 20.

Figure 4:
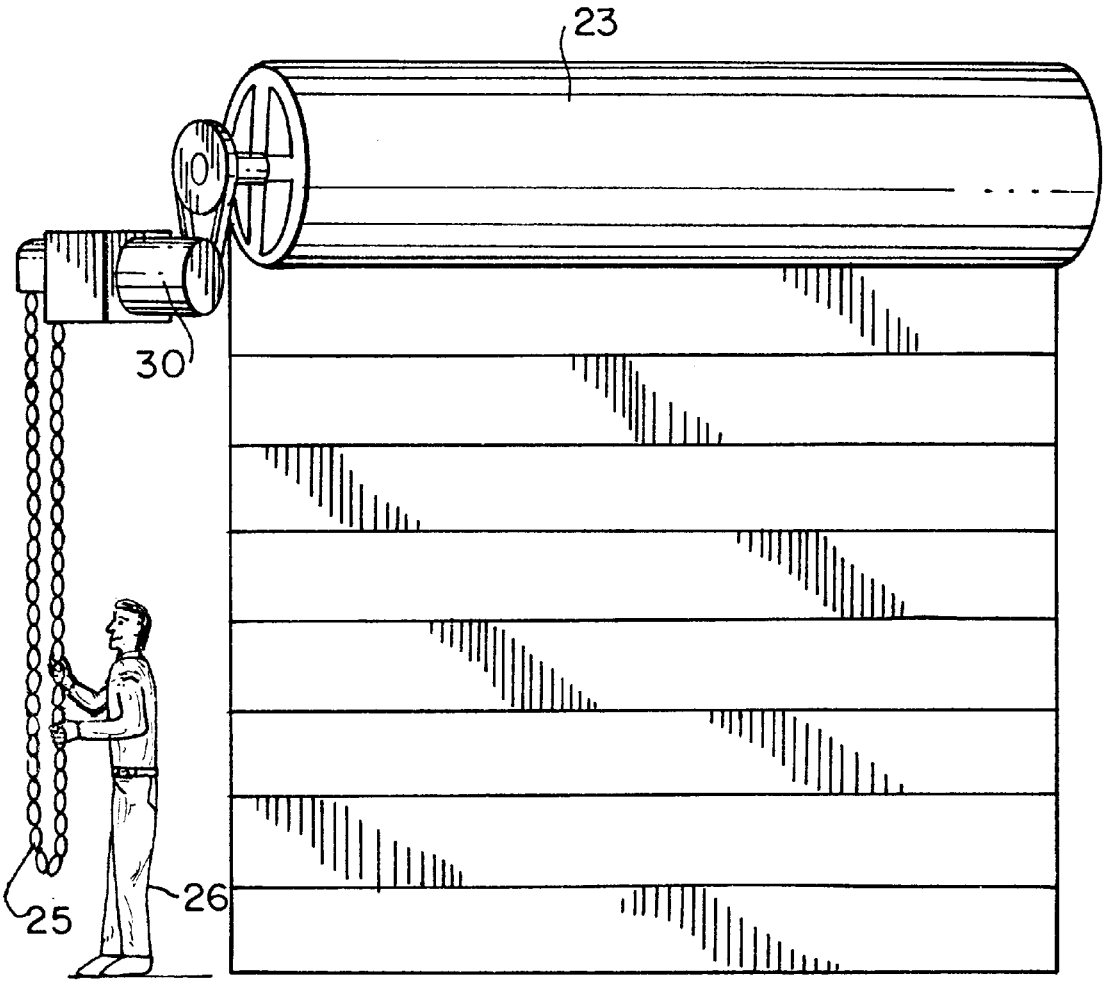
FIG. 4 is a schematic representation of a roller door motor, manual operating chain and operator in accordance with the present invention.
Figure 5:
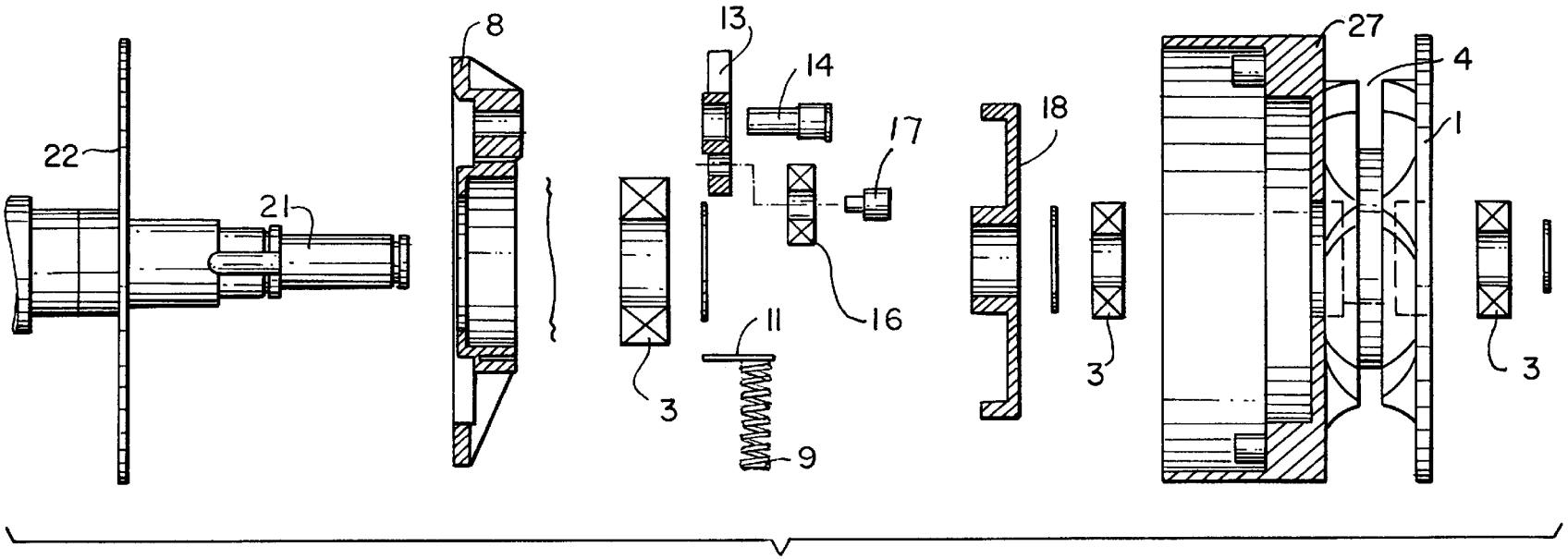
FIG. 5 is an exploded view of the components of FIGS. 1, 2 and 3 hereof indicating their inter-relationship.

The inter-relationship between the chain pulley wheel of FIG. 1, the clutch disc of FIG. 2 and the driven disc of FIG. 3 is best illustrated by reference to FIG. 5 wherein the shaft 21 is depicted upon which the three components are located. It will be appreciated that the shaft is the end of the motor shaft with the motor (not shown) lying to the left of plate 22 depicted in FIG. 5. The positioning of the motor 30 with respect to the roller door 23 and roller door drum 24 is depicted in FIG. 4. The chain for manual operation 25 and operator 26 are also depicted in FIG. 4. With reference again to FIG. 5 it will be observed that the chain pulley wheel 1 is configured at its left-hand extremity as a drum 27 which when assembled onto shaft 21 actually houses and hides driven wheel 18 and clutch disc 8. It will be appreciated that the smaller diameter of the driven wheel 18 with respect to both the clutch disc 8 and the drum 27 of the chain pulley wheel 1 permits driven disc 18 to be interposed between the clutch disc and the chain pulley wheel.

In use the springs 9 and 10 attached to flange 11 bias spring pin 6 on chain pulley wheel 1 to an equilibrium fixed position with respect to the clutch disc and hence the two wheels normally sit in a fixed relationship with each other with drive pin 7 captivated within slot 15 and the drive pawl thereby maintained at the position depicted in FIG. 2 with drive wheel 16 not engaged with arcuate drive pockets 28 disposed around the internal peripheral portions of external peripheral flange 29 on the driven disc 18. The clutch disc and chain pulley wheel maintain this relationship irrespective of whether or not the motor is turning shaft 21 having regard to the fact that there are bearings 3 interposed between both these components and shaft 21.

It is only when a rotating force is exerted at the peripheral portions of chain pulley wheel 1 by the chain pulling against bulkheads 5 that spring pin 6 urges against one of springs 9 or 10 (depending upon the direction of rotation). The resilient deformation of one of springs 9 or 10 allows relative rotation between the clutch disc and chain pulley wheel such that drive pin 7 on the chain pulley wheel will cause rotation of drive pawl 13 about its pivot pin 14. This rotation brings drive wheel 16 out towards the peripheral portions of the clutch disc and more importantly into engagement with driven pockets 28 on driven disc 18. Once drive wheel 16 is in engagement with one of arcuate driven pockets 28 further rotational forces being exerted on the chain pulley wheel by the chain will result in rotation of shaft 21 having regard to the fact that driven disc 18 is keyed thereto. Manual operation of the roller door is thereby facilitated.

It should be appreciated that the locking of drive wheel 16 into one of the arcuate driven pockets 28 not only locks the clutch disc to the driven disc 18 but also the clutch disc is still constrained to spin with the pulley wheel having regard to the link between the two which is created by drive pin 7 being captivated within slot 15.

It will be appreciated that once the driving force on chain pulley wheel 1 ceases due to the operator 26 ceasing to pull on chain 25 the restorative action of either spring 9 or spring 10 will cause spring pin 6 to once again adopt its equilibrium position within passage 12 between springs 9 and 10 and hence cause drive pin 7 to move drive pawl 13 back into the position depicted in FIG. 2 whereat it is no longer engaged via drive wheel 16 to driven disc 18.

At the equilibrium position motorised operation of the door may be once again activated without rotating either clutch disc 8, chain pulley wheel 1 or chain 25 having regard to the fact that at the equilibrium position the driven disc is no longer in engagement with drive wheel 16 or the clutch disc.

More positive pawl arrangements may be devised other than that depicted with reference to FIG. 2 hereof as it will be appreciated that excessive torque applied to the chain pulley wheel could cause circular drive wheel 16 to jump from one arcuate driven pocket to an adjacent driven pocket. The arrangement depicted is however intended to prevent damage to the system or danger to a person adjacent the chain in the event that the chain is inadvertently pulled thereby applying torque to the chain pulley wheel during motorised operation of the door. In the case of such an unintentional engagement of the clutch it will be appreciated that rotation of drive wheel 16 and the jumping of drive wheel 16 from one driven pocket to adjacent driven pockets will tend to cause less damage to the system and a less positive engagement of the clutch disc to the driven disc than would be the case if for example a pawl and ratchet system were utilised.

It will be appreciated that alternate embodiments apart from that above described may be devised without departing from the scope and intendment of the present invention. For example it should be obvious that differing shaped drive pawls may be utilised and for example the drive pawl (and associated drive pin 7 on the chain pulley wheel) do not need to be one hundred and eighty degrees removed from springs 9 and 10 about the clutch disc.

The above described embodiment presumes that the clutch mechanism of the present invention is utilised to facilitate manual actuation of roller doors which are normally motor driven. There are however roller doors which are not motor driven but are intended to operate under the influence of gravity or other biasing means in the event of fire or the happening of other predetermined events. The present invention has application in respect of such non-motor driven doors and the scope of the following claims is intended to encompass such applications.

I claim:

1. A clutch for providing manual operation by a chain of a motor driven device including a main shaft on which the device rotates when the motor driven device is operated on by the motor, wherein the motor is disengagable from the motor driven device by the clutch, and wherein the motor includes a shaft on which the clutch is mounted, comprising:

a chain pulley wheel comprising a face and an axis rotationally journalled on the motor shaft for storing the chain that is operable by a user to manually move the motor driven device and which will rotate independently when the user operates the chain so as to engage the clutch so that the motor driven device can be manually moved;

a clutch disc having a concentric axis with the chain pulley wheel and concentrically rotationally journalled with the chain pulley wheel on the motor shaft and which is operable to cause the chain to manually drive the motor driven device;

a linking element disposed on a periphery of the chain pulley wheel and engaged to the clutch disc for linking the clutch disc to the chain pulley wheel to cause the chain pulley wheel and clutch disc to move rotationally together;

a resilient biasing element mounted to the clutch disc and engagable with the linking element for biasing the clutch disc and chain pulley wheel through the linking element into an equilibrium position when the user does not operate the chain to rotate the chain pulley wheel;

a driven disc having a concentric axis with the clutch disc and the chain pulley wheel and mounted concentrically between the clutch disc and the chain pulley wheel on the motor shaft in a fixed position to prevent the driven disc from independently rotating on the motor shaft and for translating the rotational motion of the chain pulley wheel to the clutch disc and shaft so as to move the motor driven device when the user manually operates the chain;

a drive pawl comprising a pivot point mounted in an off-axis position on the clutch disc and linked at a point on the clutch disc to the chain pulley wheel operable for movement about the pivot point when biased by the chain pulley wheel from a disengaged position wherein the drive pawl does not contact the driven disc to an engaged position wherein the drive pawl engages the driven disc thereby causing the driven disc, clutch disc and chain pulley wheel to rotate together, and wherein when the clutch disc is in the equilibrium position, the pawl adopts its disengaged position and when the user operates the chain, the pawl rotates around its pivot point with respect to the driven disc to move the clutch disc from its equilibrium position by overcoming the resilient biasing means to manually engage the motor driven device.

2. The clutch of claim 1, wherein the linking element comprises a protrusion projecting from the face of the chain pulley wheel and operable to be captivated in a passage on the clutch disc defined by the resilient biasing element, wherein the resilient biasing element is operable to deform to bias the protrusion so as to permit limited lateral movement of the protrusion with respect to the resilient biasing element thereby permitting limited lateral movement between the chain pulley wheel and the clutch disc.

3. The clutch of claim 1 further comprising a pin mounted on the chain pulley wheel operable to engage in and be captivated by a radial slot in the drive pawl for securing the drive pawl to the chain pulley wheel.

4. The clutch of claim 1, wherein the driven disc comprises an upstanding flange having a radial surface, and a plurality of arcuate drive pockets on the radial surface, wherein the pawl further comprises a drive wheel and a pin on which the drive wheel is rotationally journalled, the drive wheel being engagable with the plurality of arcuate drive pockets when the drive wheel is urged into the pockets thereby locking the chain pulley wheel, driven disc and clutch disc together and preventing relative motion between them.

5. The clutch of claim 1, wherein an angular position of the link point of the drive pawl mounted to the chain pulley wheel with respect to the position where the drive pawl engages the driven disc is at least 120° about the pivot point of the drive pawl.

* * * * *